US005351506A

United States Patent [19]

Febrer

[11] Patent Number: 5,351,506

[45] Date of Patent: Oct. 4, 1994

[54] FASTENER FOR JEWELRY

[75] Inventor: Antonio A. Febrer, Manacor, Spain

[73] Assignee: Perlas Manacor, S.A., Manacor, Spain

[21] Appl. No.: 1,800

[22] Filed: Jan. 8, 1993

[30] Foreign Application Priority Data

Jun. 25, 1992 [ES] Spain ..... 9202008[U]

[51] Int. Cl.[5] ..... A44B 13/02

[52] U.S. Cl. ..... 63/2; 24/600.5

[58] Field of Search ..... 65/2, 3, 4; 24/600.4–600.7

[56] References Cited

U.S. PATENT DOCUMENTS

| | | | |
|---|---|---|---|
| 129,111 | 7/1872 | Dodge | 24/600.7 |
| 3,135,031 | 6/1964 | Brosse | 24/600.6 |
| 3,537,154 | 11/1970 | Limage | 24/600.6 |
| 3,988,813 | 11/1976 | Korcey | 24/600.4 |
| 5,007,252 | 4/1991 | Mochizuki | 63/2 |

FOREIGN PATENT DOCUMENTS

| | | | |
|---|---|---|---|
| 153178 | 9/1953 | Australia | 63/2 |
| 1900451 | 8/1970 | Fed. Rep. of Germany | 24/600.5 |
| 2343440 | 10/1977 | France | 24/600.5 |
| 2489671 | 3/1982 | France | 24/600.4 |

*Primary Examiner*—Flemming Saether
*Attorney, Agent, or Firm*—Michael J. Striker

[57] ABSTRACT

A fastener for jewelry has a closing body having two diametrically opposite ends as considered in one direction each provided with a stud arranged so that a space is formed between the body and an end of each of the studs, two rings provided on ends of a jewelry string and being passable through the spaces and settable on the studs, and a closing disc provided with pins which in a closed condition close the spaces between the closing body and the studs and therefore prevent unauthorized withdrawal of the rings, the disc being movable sideward in the first direction so as to displace the pins from the spaces and therefore allow a withdrawal of the rings from the studs through the spaces.

13 Claims, 1 Drawing Sheet

FASTENER FOR JEWELRY

BACKGROUND OF THE INVENTION

The present invention relates to a fastener, especially to be used in necklaces, bracelets and other similar jewelry and costume jewelry items.

The jewelry and custom jewelry industry use fasteners of several models. All models of fasteners are based on the same single construction and operation principle in that there are male and female components having different shapes and provided with suitable auxiliary elements for their mutual locking. However, in practice such fasteners are not always reliable. For example, in practice during their use the loose part of their basic characteristic to operate properly, especially the characteristics of the springs. As a result an unauthorized opening of the fastener can occur.

SUMMARY OF THE INVENTION

Accordingly, it is an object of the present invention to provide a fastener for jewelry, which avoids the disadvantages of the prior art.

In keeping with these objects and with ethers which will become apparent hereinafter, one feature of the present invention resides, briefly stated, in a fastener for jewelry having a closing body having two diametrically opposite ends as considered in one direction each provided with a stud arranged so that a space is formed between the body and an end of each of the studs, two rings provided on ends of a jewelry string, the rings being passable through the spaces and settable on the studs, and a closing disc provided with pins which in a closed condition close the spaces between the closing body and the studs and therefore prevent unauthorized withdrawal of the rings, the disc being movable sideward in the first direction so as to displace the pins from the spaces and therefore allow a withdrawal of the rings from the studs through the spaces.

When the fastener is designed in accordance with the present invention it has male and female elements, wherein in accordance with the present invention a double group of the elements are provided symmetrically arranged at both sides of a fastening block, so that in addition it is possible to take apart any of the female parts. Once the female parts are placed on the male parts, they are completely locked by closing pins provided on the closing and safety disc and moveable sidewards to overcome the resistance of a spring arranged between the fastener body and so as to Keep the safety disc in a closing position to prevent the female part to go from without drawing.

In accordance with the present invention the closing disc as well as the block of the fastener remain externally covered with surfaces of the same appearance as that of the parts of the jewelry itself. Therefore the assembly exhibits perfect continuity in ornamental and aesthetic sense.

The novel features which are considered as characteristic for the invention are set forth in particular in the appended claims. The invention itself, howsoever, both as to its construction and its method of operation, together with additional objects and advantages thereof, will be best understood from the following description of specific embodiments when read in connection with the accompanying drawings.

BRIEF DESCRIPTION OF THE DRAWINGS

FIG. I is an exploded view of a fastener for jewelry in accordance with the present invention.

DESCRIPTION OF THE PREFERRED EMBODIMENTS

Figure 1:
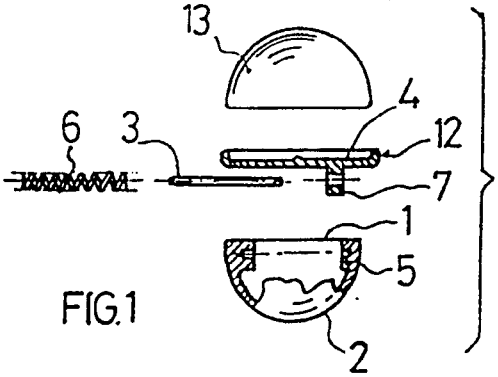
Figure 2:
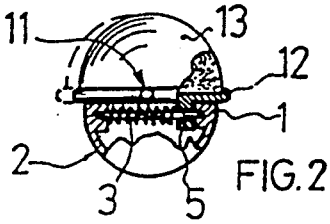
FIG. 2 is a partially sectioned side view of the fastener in accordance with the present invention, in a position corresponding to the position of FIG. 1.
Figure 3:
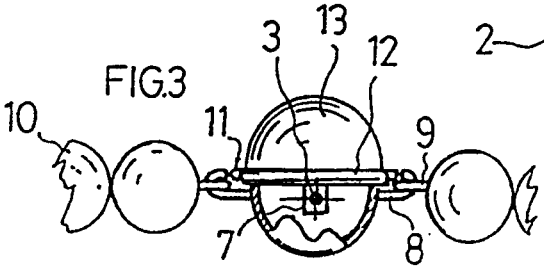
FIG. 3 is a partially sectioned side view of the inventive fastener in a closed position.
Figure 4:
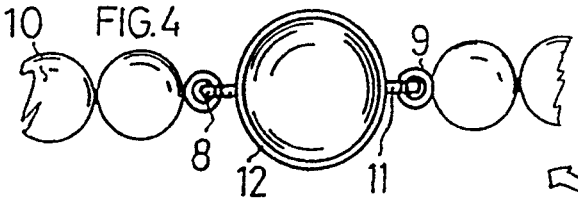
FIG. 4 is a plan view of the inventive fastener of FIG. 3.
Figure 5:
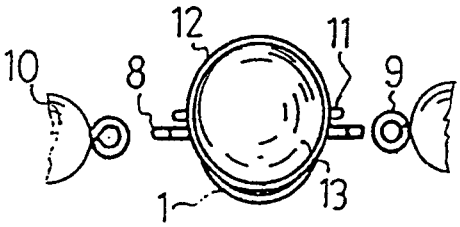
FIG. 5 is a view substantially corresponding to the view of FIG. 4 but showing the fastener in its open position with end parts taken apart.
Figure 6:
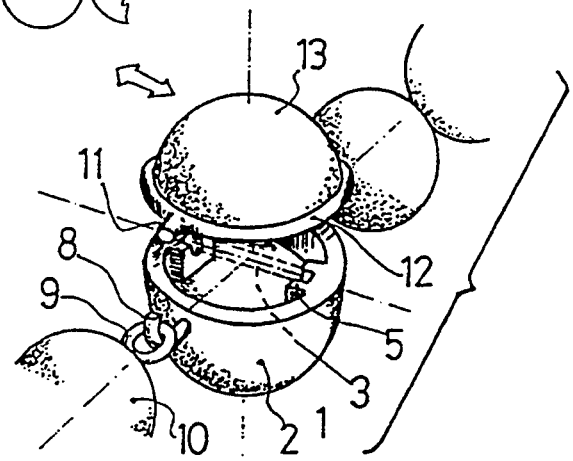
FIG. 6 is a partially sectioned and exploded perspective view of main elements of the fastener in accordance with the present invention.

A fastener for necklaces, bracelets and other jewelry and costume jewelry items in accordance with the present invention has a closing body or a block which is identified with reference numeral 1. The closing body has a lower substantially spherical surface 2 and an upper surface having a large flat area. A guiding shaft 3 is arranged on the flat area of the upper surface of the closing block 1, and a closing and safety disc 4 moves anglewise and sidewards on the guiding shaft 3. The guiding shaft 3 is locked in supporting protrusions 5 provided in the block 1. A cylindrical spring 6 is arranged on the guiding shaft 3 and acts on a lower protrusion 7 of the closing disc 4. Therefore, the spring keeps the closing disc 4 in a position coincident with the block 1, and each constitutes a true closing position.

The block 1 is provided at its both sides with studs 8. The studs 8 are arranged on a theoretical axis of a string of pearls and perpendicular to a theoretical axis of displacement of the closing disc 4. One stud is located at each side of the block 1, and the studs 8 are symmetrical relative to one another. Rings 9 provided on the ends of the string of pearl 10 are arranged on the studs 8.

A space between the block 1 and the end of the stud 8 is used for introducing and withdrawing the end ring 9 which forms a female part of the fastener. The closing disc 4 has a perimeter rim 4 provided with a pin 11 which bridges the space between the block 1 and the end of the stud 8. An element 13 having a substantially spherical surface which corresponds to the spherical surface 2 of the block 1 is lockable on the closing disc 4.

When it is desired to take apart any of the rings 9 and the studs 8 on which it is set, a user simply presses down the spherical element 13 on the closing disc 4 to overcome the action of the inner spring 6 and to provoke a sideward angular movement of the closing disc 4. The pins 11 therefore do not bridge any more the spaces between the block 1 and the ends of the studs 8. When the pressure is no longer applied by a user, the closing disc 4 moves sideward in an opposite direction and returns to its initial position and thereby the rings 9 are again fixed on the studs 8. The pin 11 closes the spaces between the block 1 and the ends of the studs 8.

The fastener in accordance with the present invention has a simple construction, it provides reliable closing position and is easy to convert it from a closing position and vice versa.

It is to be understood that the fastener and its elements can be of any sizes, shapes, quality and type of material, as well as external and decorative aspects within the spirit of the present invention.

It will be understood that each of the elements described above, or two or more together, may also find a useful application in other types of constructions differing from the types described above.

While the invention has been illustrated and described as embodied in a fastener for jewelry, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A fastener for jewelry comprising a closing body having two diametrically opposite ends as considered in a first direction each provided with a stud arranged so that a space is formed between said body and an end of each of said studs; two rings provided on ends of a jewelry string, said rings being passable through said spaces and settable on said studs; and a closing disc radially extending in a plane and provided with pins which in a closed condition close said spaces between said closing body and said studs and therefore prevent unauthorized withdrawal of said rings and in an open condition opens said spaces, said closing disc being movable sideward in said plane in a second direction which is transverse to said first direction from said closed condition to said open condition so as to displace said pins from said spaces and therefore allow a withdrawal of said rings from said studs through said spaces and also back from said open condition to said closed condition so as to displace said pins for closing said spaces.

2. A fastener as defined in claim 1; and further comprising spring means which urge said closing disc to the closed position in which said pins close said spaces between said closing body and said studs, said closing disc being displaceable sideward against a force of said spring means.

3. A fastener as defined in claim 2, wherein said closing body is provided with a guiding shaft on which said closing disc is displaceable sideward in said second direction said spring means including a spring arranged on said shaft and acting on said closing disc.

4. A fastener as defined in claim 3, wherein said closing disc has a lower supporting protrusion, said spring being cylindrical and acting on said lower supporting protrusion of said closing disc.

5. A fastener as defined in claim 1, wherein said closing body and said closing disc having opposite surfaces which face away from one another and have shapes corresponding to shapes of elements of a jewelry article which the fastener fastens.

6. A fastener as defined in claim 5, wherein said outer surfaces of said closing body and said closing disc are semi-spherical surfaces, so that the closing body together with said closing disc form a spherical shape.

7. An article of jewelry, comprising a string with a plurality of jewelry elements and having two opposite ends; and a fastener for releasably connecting said ends of said string, said fastener having two diametrically opposite ends as considered in a first direction each provided with a stud arranged so that a space is formed between said body and an end of each of said studs, two rings provided on ends of a jewelry string, said rings being passable through said spaces and settable on said studs, and a closing disc radially extending in a plane and provided with pins which in a closed condition close said spaces between said closing body and said studs and therefore prevent unauthorized withdrawal of said rings and in an open condition opens said spaces, said closing disc being movable sideward in said plane second direction which is transverse to said first direction from said closed condition to said open condition so as to displace said pins from said spaces and therefore allow a withdrawal of said rings from said studs through said spaces and also back from said open condition to said closed condition so as to displace said pins for closing said spaces.

8. An article of jewelry as defined in claim 7, wherein said jewelry elements of said string have a predetermined shape, said closing body and said closing disc having outer surfaces facing away from one another and having a shape corresponding to the shape of said jewelry elements.

9. An article of jewelry as defined in claim 8, wherein said jewelry elements are spherical, said closing body and said closing disc together forming a spherical body with a shape corresponding to a shape of said spherical jewelry elements.

10. A fastener for jewelry comprising a closing body having two diametrically opposite ends as considered in one direction each provided with a stud arranged so that a space is formed between said body and an end of each of said studs; two rings provided on ends of a jewelry string, said rings being passable through said spaces and settable on said studs; a closing disc provided with pins which in a closed condition close said spaces between said closing body and said studs and therefore prevent unauthorized withdrawal of said rings, said disc being movable in said first direction so as to displace said pins from said spaces and therefore allow a withdrawal of said rings from said studs through said spaces; and spring means which urge said closing disc to the closed position in which said pins close said spaces between said closing body and said studs, said closing disc being displaceable against a force of said spring means, said closing body being provided with a guiding shaft on which said closing disc is displaceable in said first direction, said spring means including a spring arranged on said shaft and acting on said closing disc, said closing body having two inner supporting protrusions spaced from one another in said second direction, said guiding shaft having two ends locked in said supporting protrusions.

11. A fastener for jewelry comprising a closing body having two diametrically opposite ends as considered in one direction each provided with a stud arranged so that a space is formed between said body and an end of each of said studs; two rings provided on ends of a jewelry string, said rings being passable through said spaces and settable on said studs; and a closing disc provided with pins which in a closed condition close said spaces between said closing body and said studs and therefore prevent unauthorized withdrawal of said rings, said disc being movable in said first direction so as to displace said pins from said spaces and therefore allow a withdrawal of said rings from said studs through said spaces, said closing body being provided with a guiding shaft on which said closing disc is displaceable in said first direction, said closing body having two inner supporting protrusions spaced from one another in said second direction, said guiding shaft having two ends locked in said supporting protrusions.

12. An article of jewelry, comprising a string with a plurality of jewelry elements and having two opposite ends; a fastener for releasably connecting said ends of said string, said fastener having two diametrically opposite ends as considered in one direction each provided with a stud arranged so that a space is formed between said body and an end of each of said studs, two rings provided on ends of a jewelry string, said rings being passage through said spaces and settable on said studs, and a closing disc provided with pins which in a closed condition close said spaces between said closing body and said studs and therefore prevent unauthorized withdrawal of said rings, said disc being movable in said first direction so as to displace said pins from said spaces and therefore allow a withdrawal of said rings from said studs through said spaces; and spring means which urge said closing disc to the closed position in which said pins close said spaces between said closing body and said studs, said closing disc being displaceable against a force of said spring means, said closing body being provided with a guiding shaft on which said closing disc is displaceable in said first direction, said spring means including a spring arranged on said shaft and acting on said closing disc, said closing body having two inner supporting protrusions spaced from one another in said second direction, said guiding shaft having two ends locked in said supporting protrusions.

13. An article of jewelry, comprising a string with a plurality of jewelry elements and having two opposite ends; and a fastener for releasably connecting said ends of said string, said fastener having two diametrically opposite ends as considered in one direction each provided with a stud arranged so that a space is formed between said body and an end of each of said studs, two rings provided on ends of a jewelry string, said rings being passage through said spaces and settable on said studs, and a closing disc provided with pins which in a closed condition close said spaces between said closing body and said studs and therefore prevent unauthorized withdrawal of said rings, said disc being movable in said first direction so as to displace said pins from said spaces and therefore allow a withdrawal of said rings from said studs through said spaces, said closing body being provided with a guiding shaft on which said closing disc is displaceable in said first direction, said closing body having two inner supporting protrusions spaced from one another in said second direction, said guiding shaft having two ends locked in said supporting protrusions.

* * * * *